US009924274B2

(12) United States Patent
Sancisi et al.

(10) Patent No.: US 9,924,274 B2
(45) Date of Patent: Mar. 20, 2018

(54) INERTIAL ELECTROACOUSTIC TRANSDUCER UNIT

(71) Applicant: ASK INDUSTRIES SOCIETA' PER AZIONI, Monte San Vito (IT)

(72) Inventors: Carlo Sancisi, Chiaravalle (IT); Marco Fava, Montemarciano (IT)

(73) Assignee: ASK INDUSTRIES SOCIETA' PER AZIONI, Monte San Vito (AN) (IT)

( * ) Notice: Subject to any disclaimer, the term of this patent is extended or adjusted under 35 U.S.C. 154(b) by 0 days.

(21) Appl. No.: 15/155,406

(22) Filed: May 16, 2016

(65) Prior Publication Data

US 2016/0345101 A1 Nov. 24, 2016

(30) Foreign Application Priority Data

May 22, 2015 (IT) ..... 102015000017141

(51) Int. Cl.
*H04R 9/02* (2006.01)
*H04R 9/06* (2006.01)

(52) U.S. Cl.
CPC ..... *H04R 9/025* (2013.01); *H04R 9/066* (2013.01); *H04R 9/063* (2013.01); *H04R 2400/07* (2013.01)

(58) Field of Classification Search
CPC ..... H04R 9/04; H04R 9/063; H04R 9/066; H04R 9/025
See application file for complete search history.

(56) References Cited

U.S. PATENT DOCUMENTS 5,323,466 A * 6/1994 Geddes ..... F01N 1/065 381/412
6,091,828 A * 7/2000 Akino ..... H04R 9/08 381/170
6,212,284 B1 * 4/2001 Puls ..... H04R 1/24 381/182
6,373,362 B1 * 4/2002 Kim ..... B06B 1/045 335/222
6,553,125 B2 * 4/2003 Kobayashi ..... H04R 9/06 381/396
6,681,025 B2 * 1/2004 Maekawa ..... H04R 9/063 340/7.58
6,741,721 B2 * 5/2004 Fukawatase ..... H04R 9/00 381/396

(Continued)

FOREIGN PATENT DOCUMENTS

JP S6025910 2/1985
WO 2011/029768 A1 3/2011

*Primary Examiner* — Fan Tsang
*Assistant Examiner* — Angelica M McKinney
(74) *Attorney, Agent, or Firm* — Egbert Law Offices, PLLC

(57) ABSTRACT

An inertial electroacoustic transducer unit has a first exciter and a second exciter, the second exciter is disposed in overturned position on the first exciter. In a first configuration, the bases of the two cups face each other, or in a second configuration the cavities of the two cups face each other. The two exciters are fixed together or to a plane intended to be put into vibration in such manner that the axes of the cylindrical supports of the coils coincide. The ends of the coils of the two exciters are connected in counter-phase in such manner to obtain a consistent movement in the same direction as the magnetic units of the two exciters.

11 Claims, 7 Drawing Sheets

(56) References Cited

U.S. PATENT DOCUMENTS

| | | | | |
|---|---|---|---|---|
| 6,744,895 | B2 * | 6/2004 | Miyamoto | H04R 9/063 381/182 |
| 7,106,878 | B2 * | 9/2006 | Saiki | H04M 1/03 381/182 |
| 7,162,050 | B2 * | 1/2007 | Furuya | H04R 9/063 381/182 |
| 7,519,191 | B2 * | 4/2009 | Enomoto | H04R 9/025 381/186 |
| 8,452,041 | B2 * | 5/2013 | Nedelcu | H04R 9/022 381/397 |
| 2004/0071303 | A1 * | 4/2004 | Furuya | H04M 1/035 381/182 |
| 2004/0228494 | A1 * | 11/2004 | Smith | A61B 7/04 381/67 |
| 2006/0002578 | A1 * | 1/2006 | Kim | H04R 9/063 381/396 |
| 2011/0164774 | A1 * | 7/2011 | Gladwin | H04R 5/02 381/332 |
| 2012/0170795 | A1 * | 7/2012 | Sancisi | H04R 9/043 381/413 |
| 2014/0211963 | A1 * | 7/2014 | Dodd | H04R 1/2896 381/94.1 |

* cited by examiner

INERTIAL ELECTROACOUSTIC TRANSDUCER UNIT

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present patent application for industrial invention relates to an inertial electroacoustic transducer unit.

2. Description of Related Art Including Information Disclosed Under 37 CFR 1.97 and 37 CFR 1.98.

As it is known, a traditional loudspeaker comprises a membrane connected to a voice coil that moves in an air gap generated by a fixed magnetic unit. The vibration of the membrane generates a sound.

JP S60 25910 discloses a traditional loudspeaker comprising a membrane connected to a single cylindrical support. A first coil and a second coil are mounted at the ends of the single cylindrical support. Two magnetic units generate corresponding air gaps for the two coils.

Each magnetic unit is of conventional type and comprises a polar core, a toroidal magnet and a polar plate. A magnetic fluid is disposed in the air gap of each magnetic unit in such manner to center the cylindrical support of the coils. Therefore such a loudspeaker does not provide for any elastic suspension that centers the cylindrical support of the coils with respect to the magnetic units.

The magnetic units are locked in position and the cylindrical support of the coils can vibrate in such manner to cause the vibration of the membrane fixed to the cylindrical support.

Recently, inertial electroacoustic transducers, which are commonly known as exciters or shakers, have become popular as an alternative to traditional membrane loudspeakers.

The exciter comprises a coil fixed to a flange intended to be fixed to a rigid element. A centering device supports a magnetic unit in such manner that the magnetic unit generates an air gap wherein the coil is positioned and the magnetic unit can move with respect to the coil. Consequently, vibrations are propagated in the rigid element fixed to the flange of the exciter generating a sound.

Therefore, the inertial electroacoustic transducer is based on a completely different operating principle with respect to a traditional loudspeaker. The exciter is configured in such manner that the magnetic unit moves, while the cylindrical support of the coil remains still. Instead, the traditional loudspeaker is configured in such manner that the cylindrical support of the coil moves, while the magnetic unit remains still. Therefore, an expert of the field who intends to make an inertial electroacoustic transducer would not take a traditional loudspeaker into consideration.

WO2011/029768 in the name of the same applicant discloses an exciter. FIG. 1 shows an exciter according to WO2011/029768, which is generally indicated with reference numeral (100).

The exciter (100) comprises a coil (1) mounted on a cylindrical support (10). The cylindrical support (10) is fixed to a flange (2). The flange (2) comprises a central collar (20) to which the cylindrical support (10) of the coil is fixed. The flange (2) is intended to be fixed to a rigid element (not shown in FIG. 1), such as for example a panel of rigid material, which will be put in vibration to generate a sound.

The flange (2) is connected to a centering device (3) comprising an elastic suspension that supports a magnetic unit (4). The magnetic unit (4) comprises a cup (40) with a base (41) and a lateral wall (42) with a border (46) that define a cylindrical housing wherein a magnet (43) and a polar plate (44) are disposed.

The magnet (43) has a cylindrical shape and is centrally disposed inside the seat of the cup (40) and fixed to the base (41) of the cup (40). The polar plate (44) has a cylindrical shape and is fixed to the magnet (43). The polar plate (44) has a free surface (45) flush with the border (46) of the lateral wall of the cup.

The magnet (43) and the polar plate (44) have a lower diameter than the seat of the cup (40). Consequently, an air gap (T) with toroidal shape is generated between the external lateral surface of the magnet (43) and of the polar plate (44) and the internal lateral surface of the lateral wall (41) of the cup.

The magnetic unit (4) is held by the centering device (3) in such manner that the coil (1) is disposed in the air gap (T).

The centering device (3) comprises an external cylinder (30) fixed to the flange (2) and an internal cylinder (31) fixed to the cup (40). The external cylinder (30) is higher than the internal cylinder (31). The external cylinder (30) of the centering device is connected to the internal cylinder (31) by means of elastically flexible spokes (32) in such manner that the internal cylinder (31) is disposed in concentric position inside the external cylinder (30). In view of the above, the magnetic unit (4) can move in axial direction with respect to the cylindrical support (10) of the coil, along an axis (A) that coincides with the axis of the cylindrical support of the coil.

This type of exciter is impaired by some drawbacks in terms of harmonic distortion.

As it is known, the aforementioned magnetic circuit, which is commonly used in inertial electroacoustic transducers, does not provide a constant magnetic induction field in the air gap and in proximity of regions outside the air gap.

In order to explain this situation, let's consider a hypothetical cylindrical surface, for example a region of the cylindrical support (10), with height equal to 2 times the height of the polar plate (44), symmetrically positioned in axial direction with respect to the height of the polar plate (44), in such manner that said cylindrical surface projects by the same length from the planar, upper and lower surfaces (45) of the polar plate (44).

The radial lines of the magnetic field, which perpendicularly intersect said cylindrical surface and are the useful components for the movement of the magnetic unit with respect to the coil, are not generally uniform and constant in the two cylindrical surface regions that exceed the height of the polar plate (44). This is caused by geometrical arrangement of the magnetic system and can be assessed both with instruments and software simulation systems.

When the magnetic unit (4) is moved upwards in the direction of the arrow (F1), the magnetic unit gets away from the coil (1). On the contrary, when the magnetic unit (4) is moved downwards in the direction of the arrow (F2), the magnetic unit gets closer to the coil (1). These movements affect the aforementioned cylindrical surface regions that protrude from the border (46) of the polar plate (44), where the lines of the magnetic field are not constant, generating distortions in the production of mechanical vibrations and in the reproduction of sounds. Consequently, a harmonic distortion occurs.

The Total Harmonic Distortion (THD) is a measuring unit that measures total harmonic distortion, which must be taken in great consideration when assessing the quality of an audio device that needs to reproduce an audio program with high fidelity.

The purpose of the present invention is to eliminate the drawbacks of the prior art by disclosing an inertial electroacoustic transducer unit provided with low harmonic distortion.

Another purpose of the present invention is to disclose such an inertial electroacoustic transducer unit that is capable of managing high-power audio signals with reduced radial dimensions.

BRIEF SUMMARY OF THE INVENTION

These purposes are achieved according to the invention with the characteristics of the independent claim 1.

Advantageous embodiments appear from the dependent claims.

The inertial electroacoustic transducer unit of the invention comprises a first exciter and a second exciter. Each exciter comprises:

- a coil supported by a cylindrical support fixed to a flange,
- a magnetic unit comprising a cup with a base and a lateral wall that defines a cavity wherein a magnet and a polar plate are disposed in such manner to generate a toroidal air gap, and
- a centering device provided with an external cylinder fixed to said flange, an internal cylinder fixed to said cup in such manner that the coil is disposed in the air gap of the magnetic unit and elastic spokes connecting said external cylinder to said internal cylinder of the centering device, so that said magnetic unit can move axially with respect to an axis coinciding with the axis of the support of the coil when the coil is powered with electrical current.

The second exciter is in overturned position with respect to the first exciter. According to a first configuration, the bases of the two cups are disposed one towards the other, or according to a second configuration, the cavities of the two cups are disposed one towards the other.

The two exciters are fixed together or to a plane intended to be put into vibration in such manner that the axes of the cylindrical supports of the coils coincide. The ends of the coils of the two exciters are electrically connected in counter-phase.

The inertial electroacoustic transducer unit of the invention permits to minimize the harmonic distortion and manage the power of the audio signal by splitting it between the two exciters.

BRIEF DESCRIPTION OF THE SEVERAL VIEWS OF THE DRAWINGS

Additional features of the invention will appear evident from the detailed description below, which refers to merely illustrative, not limiting embodiments, wherein.

DETAILED DESCRIPTION OF THE INVENTION

Figure 1:
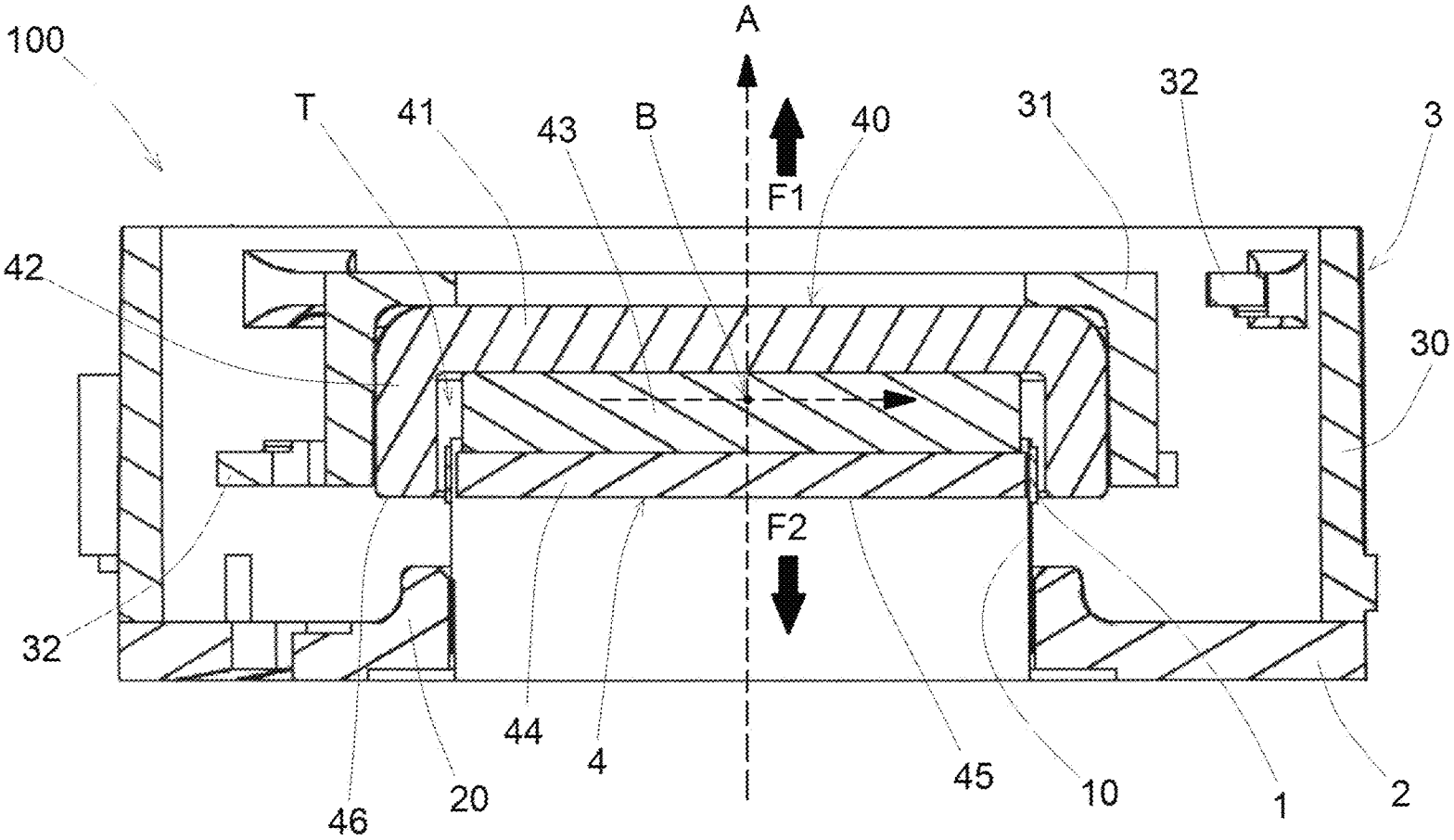
FIG. 1 PRIOR ART
FIG. 1 is an axial view of an exciter according to the prior art.
Figure 2:
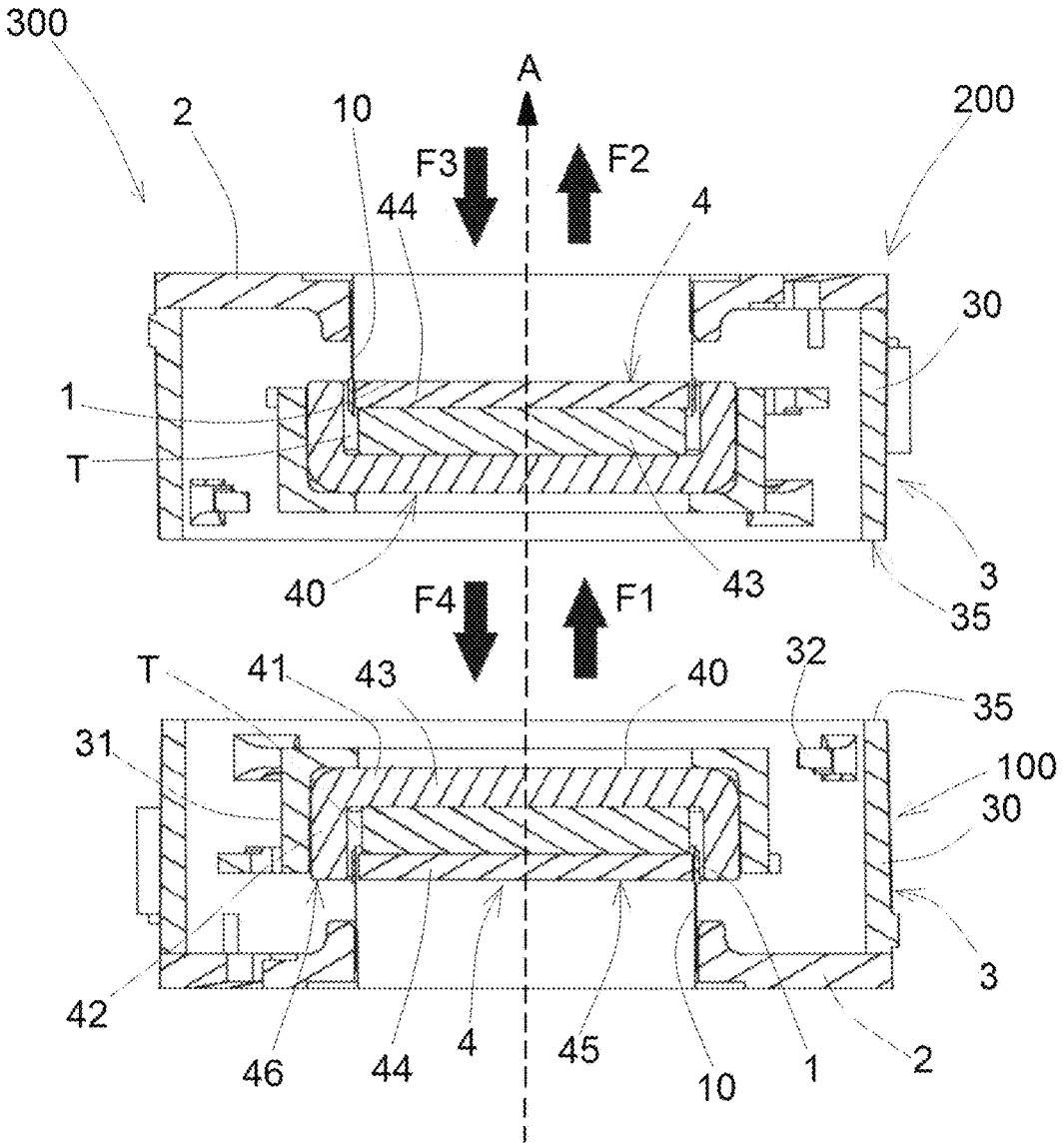
FIG. 2 is an axial exploded view of two exciters according to the prior art, which are intended to be disposed in a first configuration in such manner to obtain an inertial electroacoustic transducer unit according to the invention.

Now with reference to FIG. 2, a first embodiment of an inertial electroacoustic transducer unit according to the invention is disclosed, which is generally indicated with reference numeral (300).

The inertial electroacoustic transducer unit (300) comprises a first exciter (100) and a second exciter (200). The two exciters (100, 200) are identical. In the following description, the parts that are identical or correspond to the afore-described parts are identified with the same reference numerals, omitting their detailed description. In the following description, the terms "upper" and "lower" will refer to the arrangement of the figures, that is to say with axis (A) in vertical position, it being understood that the electroacoustic transducer unit (300) can be disposed in any type of arrangement.

With reference to FIG. 2, according to a first configuration, the first exciter (100) is disposed with the flange (2) faced downwards and the base (41) of the cup (40) of the magnetic unit faced upwards. The second exciter (200) is in overturned position with respect to the first exciter. In other words, the second exciter (200) has the flange (2) faced upwards and the base (41) of the cup (40) of the magnetic unit faced downwards. The bases (41) of the cups of the two exciters face each other.

The external cylinder (30) of the centering device (3) of each exciter has a border (35) opposite to the flange (2). The two exciters can be stacked one on top of the other, in such manner that the borders (35) of the external cylinders of the centering devices are mutually stopped and the cups (40) of the magnetic units of the two centering devices are in proximal position, one facing the other.

The second exciter (200) is fixed on the first exciter (100) in such manner that the axes (A) of the two exciters coincide.

Such fixing can be obtained by gluing or thermowelding the borders (35) of the external cylinders of the centering devices of the two exciters, or with fixing means such as connectors, clamps, clips, snap-in fitting and the like, applied to the external cylinders (30) of the centering devices.

The ends of each coil (1) are provided with two pins. The four pins of the two coils (1) are connected in counter-phase, in such manner that the magnetic units (4) of the exciters can move as desired. In order to obtain such a result with the two exciters (100, 200) mounted in axial position, it is simply necessary to join/weld the corresponding pins (the pin on top with the pin on the bottom).

In this way a consistent movement in the same direction as the magnetic units (4) of the two exciters is obtained. In other words, when the magnetic unit (4) of the first exciter (100) moves axially upwards in the direction of the arrow (F1), also the magnetic unit (4) of the second exciter (200) moves axially upwards in the direction of the arrow (F2). Similarly, when the magnetic unit (4) of the second exciter (200) moves axially downwards in the direction of the arrow (F3), also the magnetic unit (4) of the first exciter (100) moves axially downwards in the direction of the arrow (F4).

Considering that the two exciters are disposed in opposite position, when the magnetic unit (4) of the first exciter (100) gets away from the coil (1), the magnetic unit (4) of the second exciter (200) gets closer to the coil (1). Vice versa, when the magnetic unit (4) of the first exciter (100) gets closer to the coil (1), the magnetic unit (4) of the second exciter (200) gets away from the coil (1). As a result, a higher symmetry and a constant intensity of the magnetic field of the inertial electroacoustic transducer unit provided with the two exciters is obtained, considering the sum of the magnetic fields that interact with the current in the two coils. These characteristics are found in the internal and external regions of the air gaps of the two exciters affected by the axial movements of the inertial masses composed of the magnetic units and contribute to reduce the harmonic distortion of the inertial electroacoustic transducer unit (300) according to the invention.

Moreover, it must be considered that the inertial electroacoustic transducer unit (300) of the invention can manage a double electrical power than the one managed by a single exciter (100, 200). In fact, the power signal is split between the two exciters (100, 200). In such a case, the external diameter of the inertial electroacoustic transducer unit (300) is identical to the external diameter of the single exciters, thus reducing the increment in the radial dimension that is the normal consequence of the use of electrical coils with larger diameter, which are necessary to manage increasing electrical powers. Moreover, larger electrical coils require the use of larger magnetic circuits that, acting as inertial masses and becoming heavier, inevitably modify the vibrational behavior in the field of frequencies affected by the audio reproduction.

The inertial electroacoustic transducer unit (300) can be connected to any type of electrical power supply composed of a signal amplifier suitable for amplifying the electrical signal to be reproduced.

Figure 3:
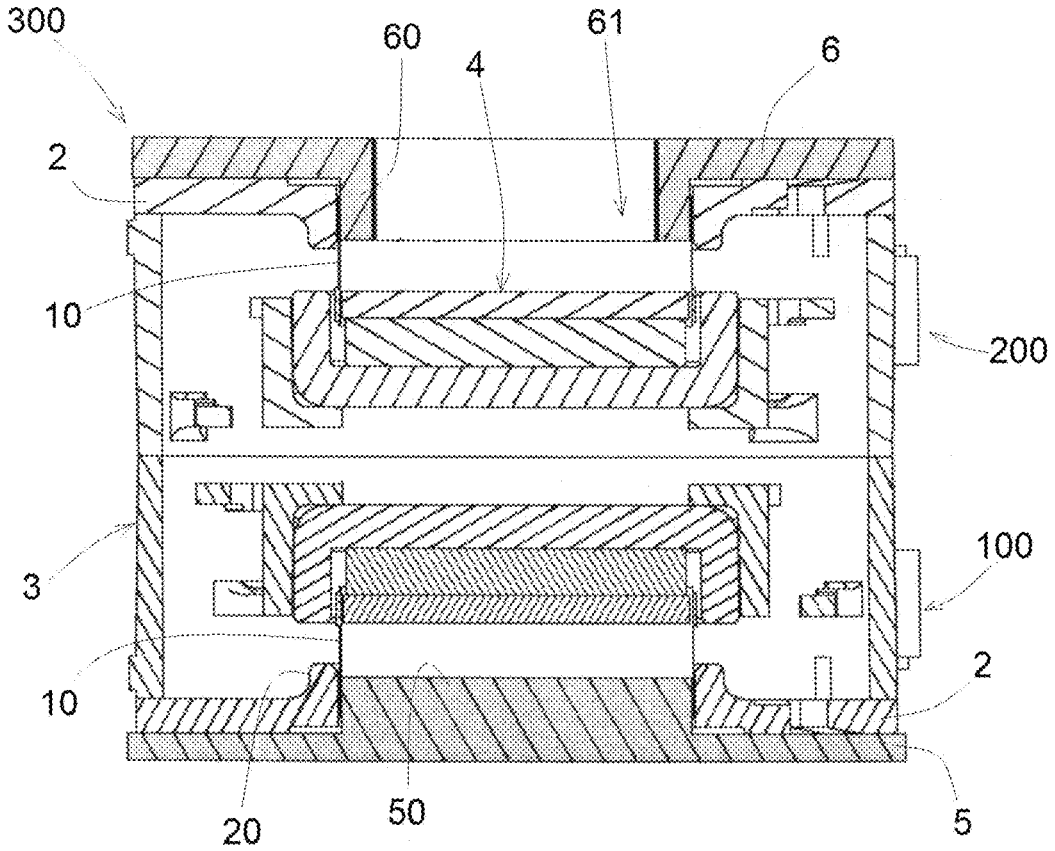
FIG. 3 is an axial view of an improvement of the inertial electroacoustic transducer unit of FIG. 2 in assembled condition.

FIG. 3 shows an improvement of the inertial electroacoustic transducer unit (300) comprising a first ending plate (50) fixed to the flange (2) of the first exciter (100) and a second ending plate (6) fixed to the flange (2) of the second exciter (200). The ending plates (5, 6) are preferably made of a rigid heat conductive material, such as for example a metal material, to dissipate the thermal energy of the cylindrical support (10) of the coil of the inertial electroacoustic transducer unit (300).

The first ending plate (5) comprises a central shank (50) pressedly inserted inside the cylindrical support (10) of the coil, in such manner to firmly fix the cylindrical support (10) of the coil between the central shank (50) of the first ending plate and the collar (20) of the flange (2). The first ending plate (5) is intended to be fixed to a rigid element that needs to vibrate to generate a sound.

The second ending plate (6) comprises a central shank (60) pressedly inserted inside the cylindrical support (10) of the coil, in such manner to firmly fix the cylindrical support (10) of the coil between the central shank (60) of the second ending plate and the central collar (20) of the flange (2). The central shank (60) of the second ending plate is open and is provided with a through hole (61) to improve heat dissipation.

Although in FIG. 3 the shank (50) of the first ending plate is closed and the shank (60) of the second ending plate is open, the shanks (50, 60) of the first and of the second ending plate can be both closed or both open in such manner to obtain a perfectly symmetrical device with respect to a plane passing through the connection surface of the two exciters (100, 200). Such a solution allows for employing multiple devices, in phase or out of phase, by simply inverting the ending plate (5, 6) that needs to come in contact with the rigid element to be put in vibration, thus simplifying the tuning of the devices for the user.

Figure 4:
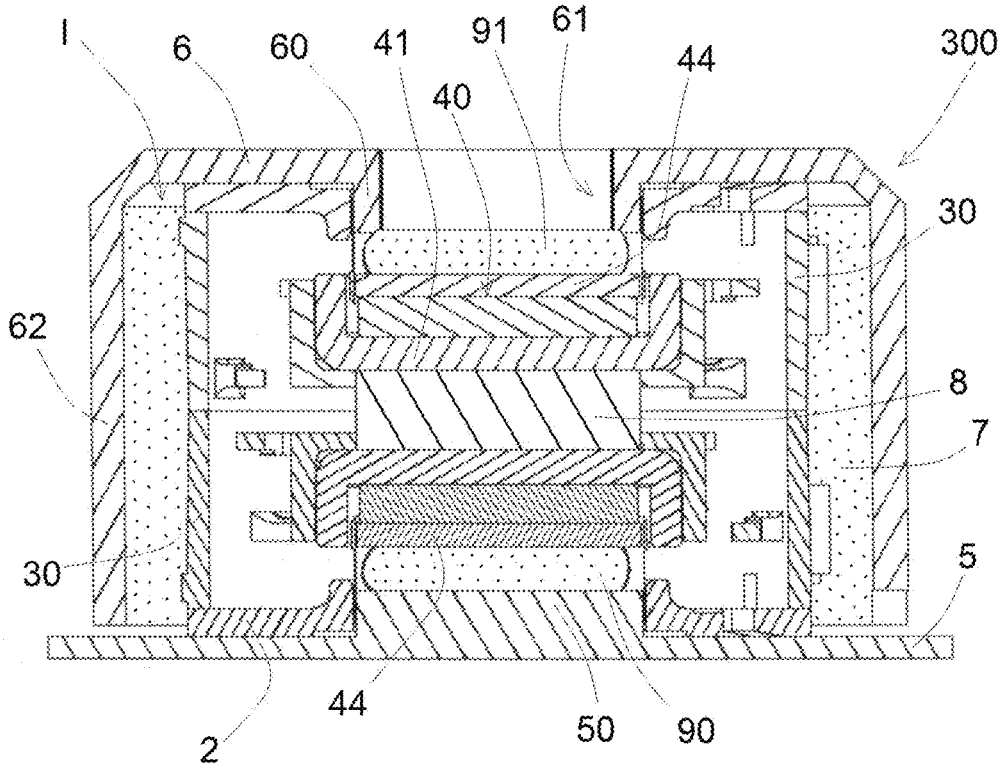
FIG. 4 is an axial view of an additional improvement of the inertial electroacoustic transducer unit of FIG. 3.

FIG. 4 shows an additional improvement of the inertial electroacoustic transducer unit (300) of FIG. 3. In such a case, the second ending plate (6) comprises a lateral wall (62) that extends outside the external cylinder (30) of the centering devices of the two exciters, until it reaches the level of the flange (2) of the first exciter (100) without touching the first ending plate (5).

A toroidal air gap (I) is defined between the external cylinders (30) of the centering devices of the two exciters and the lateral wall (62) of the second ending plate (6), said toroidal air gap (I) being filled with a sound absorbing material (7), such as foam plastic material, in order to limit any unwanted vibrations.

Although in FIG. 4 the lateral wall (62) is provided in the second ending plate (6), it appears evident that said lateral wall can be provided in the first ending plate (5) and can extend up to the second ending plate (6).

A connection partition (8) is disposed between the bases (41) of the two cups (40) of the two exciters, in such manner to join the bases (41) together. In view of the above, the magnetic units (4) are moved consistently in the same direction. Advantageously, the connection partition (8) is made of rigid heat conductive material, preferably a metal material, to allow for thermal dissipation and to obtain thermal uniformity in the two cups (40) of the magnetic units.

On the contrary, if mechanical dampening in the movement of the two magnetic units (4) is required, advantageously, the connection partition (8) is made of an elastic material, such as for example silicone gel or sponge material, to allow for mechanically dampening the movement of the two magnetic units (4).

Advantageously, the inertial electroacoustic transducer unit (300) comprises:

- a first elastic buffer (90) disposed inside the cylindrical support (10) of the coil of the first exciter, between the central shank (50) of the first ending plate and the polar plate (44) of the magnetic unit of the first exciter, and/or a second elastic buffer (91) disposed inside the cylindrical support (10) of the coil of the second exciter, between the central shank (60) of the second ending plate and the polar plate (44) of the magnetic unit of the sector exciter.

The elastic buffers (90, 91) are made of a deformable elastic material, such as for example silicone gel or sponge material. The elastic buffers (90, 91) are used both for thermal dissipation and for dampening the vibrations of the magnetic units during the movement.

Figure 5:
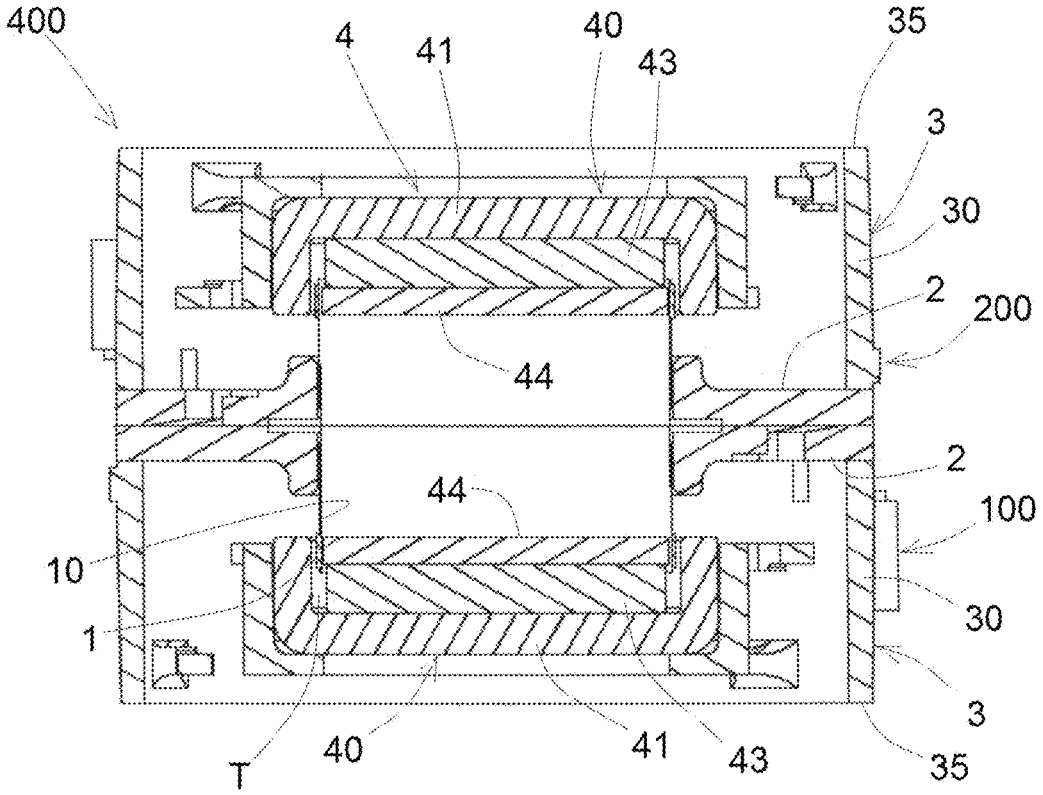
FIG. 5 is an axial view of a second embodiment of the inertial electroacoustic transducer unit of FIG. 2, wherein the two exciters are disposed in a second configuration.
Figure 6:
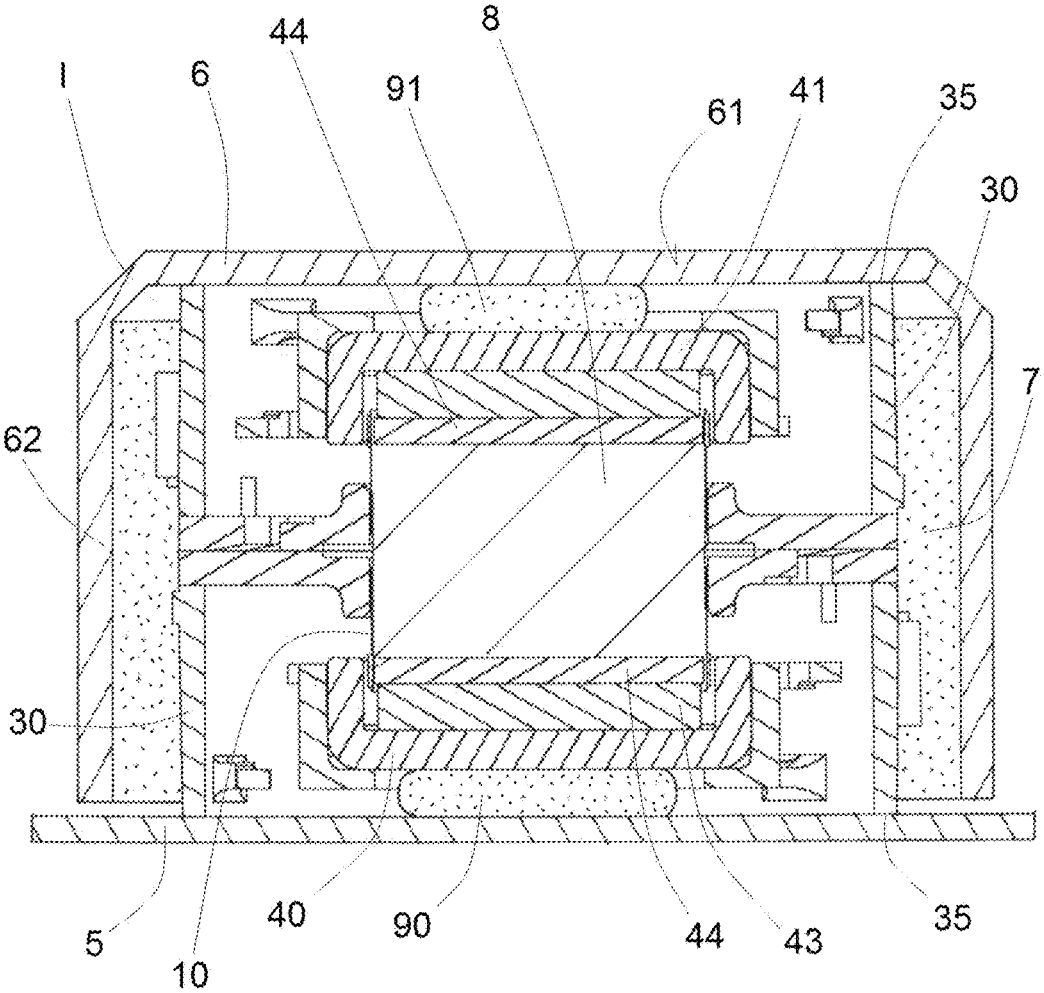
FIG. 6 is an axial view of an improvement of the inertial electroacoustic transducer unit of FIG. 5.

FIG. 5 shows a second embodiment of the inertial electroacoustic transducer unit of the invention, which is generally indicated with reference numeral (400), wherein the two exciters (100, 200) are disposed in a second configuration. The flanges (2) fixed to the external cylinder (30) of the centering devices are disposed in opposite position, one on top of the other, and fixed together in such manner that the axes (A) of the supports of the coils coincide. In such a case, the supports (10) of the coils are in proximal position and the seats of the cups (40) of the magnetic units are faced one towards the other, whereas the bases (41) of the cups are in distal position. Also in this case, the coils (1) are powered in such manner that the magnetic units (4) are moved consistently in the same direction.

In such a case, the ending plates (5, 6) are fixed to the borders (35) of the external cylinders (30) of the centering devices and the ending plates are not provided with central shank fixed to the support of the coil.

The connection partition (8) is disposed between the two polar plates (44) inside the cylindrical supports (10) of the coils in such manner to fix the polar plates together. In such a case, the connection partition (8), if any, must be made of a non-magnetic material because otherwise it would be impossible to mount, due to the magnetic attraction forces of the magnets (43). Moreover, the presence of a magnetic metal material in the connection partition would interfere with the lines of the magnetic field generated by the magnets (43), taking them away from the "useful" field confined in the air gap (T) and in its surroundings.

The elastic buffers (90, 91) are disposed between the base (40) of the cups and the corresponding ending plates (5, 6) fixed to the borders (35) of the external cylinders of the centering devices.

Figure 7:
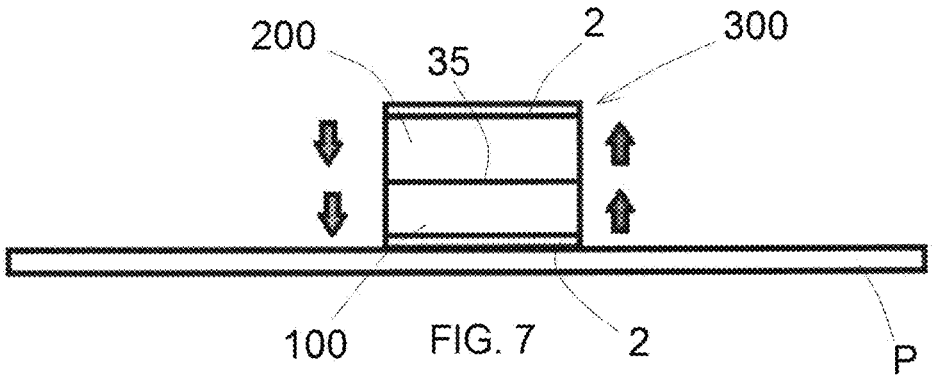
FIGS. 7 and 8 are two diagrammatic side views that show two possible applications of the inertial electroacoustic transducer unit of FIG. 2, fixed to a plane intended to be put into vibration.

FIG. 7 shows an inertial electroacoustic transducer unit (300) according to the first embodiment of FIG. 2, wherein the flange (2) of the first exciter (100) is fixed to a plane (P), such as for example a panel or a rigid plate, which is intended to be put into vibration to generate a sound. The second exciter (200) is fixed in overturned position on the first exciter (100). The ending borders (35) of the two external cylinders of the two centering devices are fixed together in such manner that the axes (A) of the cylindrical supports (10) of the coils coincide.

Figure 8:
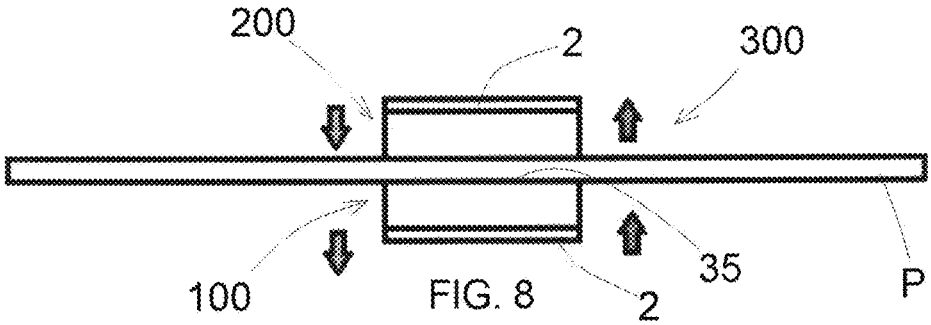

FIG. 8 shows an inertial electroacoustic transducer unit (300) according to the first embodiment of FIG. 2, wherein the borders (35) of the external cylinders of the centering devices of the first exciter (100) and of the second exciter (200) are fixed to the plane (P) on both sides of the plane (P), in such manner that the axes (A) of the cylindrical supports (10) of the coils coincide. In other words, the plane (P) to be put into vibration is disposed between the borders (35) of the external cylinders of the centering devices of the two exciters (100, 200).

Figure 9:
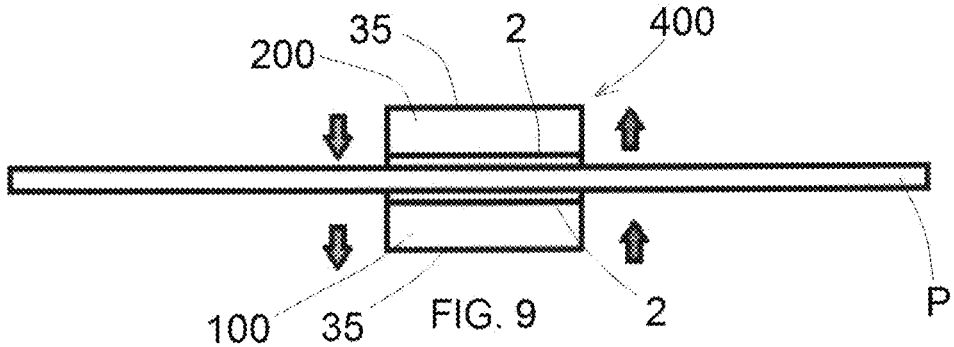
FIGS. 9 and 10 are two diagrammatic side views that show two possible applications of the inertial electroacoustic transducer unit of FIG. 5, fixed to a plane intended to be put into vibration.

FIG. 9 shows an inertial electroacoustic transducer unit (400) according to the second embodiment of FIG. 5, wherein the flanges (2) of the first exciter (100) and of the second exciter (200) are fixed to the plane (P) on both sides of the plane (P), in such manner that the axes (A) of the cylindrical supports (10) of the coils coincide. In other words, the plane (P) to be put into vibration is disposed between the two flanges (2) of the two exciters (100, 200).

Figure 10:
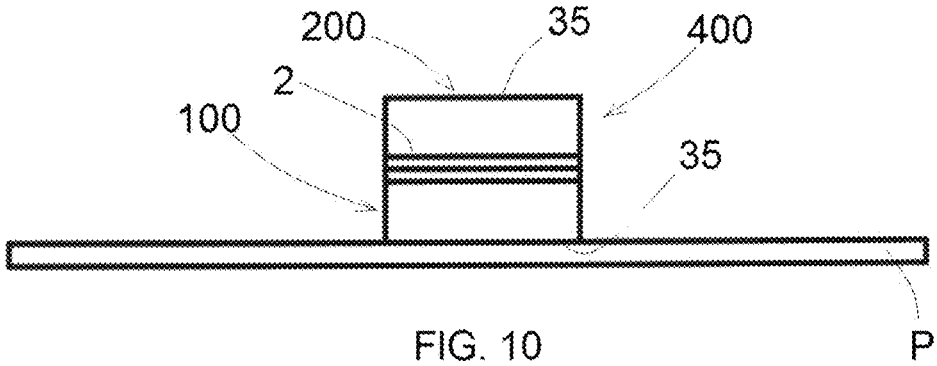

FIG. 10 shows an inertial electroacoustic transducer unit (400) according to the second embodiment of FIG. 5, wherein the ending border (35) of the external cylinder of the centering device of the first exciter (100) is fixed to the plane (P) intended to be put into vibration to generate a sound. The second exciter (200) is fixed in overturned position on the first exciter (100). In other words, the flanges (2) of the two exciters are fixed together in such manner that the axes (A) of the cylindrical supports (10) of the coils coincide.

Numerous variations and modifications can be made to the present embodiments of the invention, which are within the reach of an expert of the field, falling in any case within the scope of the invention.

We claim:

1. An inertial electroacoustic transducer unit comprising:

a first exciter; and a second exciter, wherein each of said first and second exciters comprises:

a coil supported by a cylindrical support fixed to a flange;

a magnetic unit comprising a cup with a base and a lateral wall that defines a cavity in which a magnet and a polar plate are disposed in such manner to form a toroidal air gap; and a centering device having an external cylinder fixed to said flange, an internal cylinder fixed to said cup in such manner that said coil is disposed in the toroidal air gap of said magnetic unit, and elastic spokes connecting said external cylinder to said internal cylinder of said centering device such that said magnetic unit can move axially with respect to an axis coinciding with an axis of said cylindrical support of said coil when said coil is powered with an electrical current, wherein said second exciter is disposed in an overturned position with respect to said first exciter such that the bases of the cups face each other, wherein said first and second exciters are fixed together or to a plane that is put in vibration in such a manner that the axes of the cylindrical supports of the coils coincide;

wherein each coil of the first and second exciters has two ends, the four ends of the coils of the first and second exciters being connected in counter-phase in such manner to obtain a consistent movement in a common direction as the magnetic units of said first and second exciters, wherein said external cylinder of said centering device comprises a border and said first and second exciters are disposed in such manner that the borders of the two centering devices are in mutual contact and the bases of the two cups of the magnetic units face each other, and a connection partition disposed between the bases of the two cups of the first and second exciters in such manner to join the bases, said connection partition being made of a rigid heat conductive material to allow for heat dissipation or an elastic material to allow for a mechanical damping of the movement of the two magnetic units.

2. The inertial electroacoustic transducer unit of claim 1, further comprising:

a first ending plate and a second ending plate respectively fixed to the flanges of first and the second exciters.

3. The inertial electroacoustic transducer unit of claim 2, wherein at least one of said first and second ending plates comprises a lateral wall that extends outwards and is parallel to the external cylinders of the centering devices of said first and second exciters in such manner to define a toroidal air space between the external cylinders of the centering devices and the lateral wall of the ending plate.

4. The inertial electroacoustic transducer unit of claim 3, further comprising:

a sound absorbing material disposed in the toroidal air space between the external cylinders of the centering devices and the lateral wall of the ending plate.

5. The inertial electroacoustic transducer unit of claim 2, further comprising:

at least one elastic buffer disposed inside the cylindrical support of the coil of at least one of the first and second exciters between the ending plate and a polar plate of the at least one of the first and second exciters.

6. The inertial electroacoustic transducer unit of claim 2, wherein each of the first and second ending plates comprises a central shank pressedly inserted inside the cylindrical support of the coil in such manner to firmly fix the cylindrical support of each coil between the central shank of each of the first and second ending plates and a central collar of each flange, wherein said first and second ending plates are made of a rigid heat conductive material in order to dissipate thermal energy from the cylindrical support of the coil.

7. An inertial electroacoustic transducer unit comprising:

a first exciter; and a second exciter, each of said first and second exciters comprising:

a coil supported by a cylindrical support fixed to a flange;

a magnetic unit comprising a cup with a base and a lateral wall that defines a cavity in which a magnet and a polar plate are disposed in such manner to form a toroidal air gap, and a centering device having with an external cylinder fixed to said flange, an internal cylinder fixed to said cup in such manner that the coil is disposed in the air gap of the magnetic unit, and elastic spokes connecting said external cylinder to said internal cylinder of the centering device such that said magnetic unit can move axially with respect to an axis coinciding with an axis of the cylindrical support of said coil when said coil is powered with electrical current, wherein said second exciter is disposed in an overturned position with respect to said first exciter such that the cavities of the cups face each other, wherein the first and second exciters are fixed together or to a plane that is put in vibration in such manner that the axes of the cylindrical supports of the coils coincide, each coil of said first and second exciters has two ends, the four ends of the coils of the first and second exciters being connected in counter-phase in such manner to obtain a consistent movement in a common direction as the magnetic units of the first and second exciters, wherein said external cylinder of said centering device comprises a border and said first and second exciters are disposed in such manner that the flanges of the first and second exciters are in mutual contact or fixed to the plane that is put in vibration on one side and on another side with respect to the plane, and the cavities of the two cups face each other; and a connection partition disposed between the polar plates of the first and second exciters in such a manner to join the polar plates, said connection partition being made of a rigid heat conductive material to allow for heat dissipation or an elastic material to allow for a mechanical damping of the movement of the magnetic units.

8. The inertial electroacoustic transducer unit of claim 7, comprising:

a first ending plate and a second ending plate respectively fixed to borders of the external cylinders of the centering devices.

9. The inertial electroacoustic transducer unit of claim 8, wherein at least one of said first and second ending plates comprises a lateral wall that extends outwards and is parallel to the external cylinders of the centering devices of said first and second exciters in such manner to define a toroidal air space between the external cylinders of the centering devices and the lateral wall of the ending plate.

10. The inertial electroacoustic transducer unit of claim 9, further comprising:

a sound absorbing material disposed in the toroidal air space between the external cylinders of the centering devices and the lateral wall of the ending plate.

11. The inertial electroacoustic transducer unit of claim 7, further comprising:

at least one elastic buffer disposed between the ending plate and the base of the cup of at least one of the first and second exciters inside the cylindrical support of the coil of the at least one of said first and second exciters.

* * * * *